US007980893B2

(12) United States Patent
Sato et al.

(10) Patent No.: US 7,980,893 B2
(45) Date of Patent: Jul. 19, 2011

(54) COAXIAL CONNECTOR AND CONNECTOR DEVICE

(75) Inventors: Koki Sato, Shinagawa (JP); Kazuhiro Mizukami, Shinagawa (JP); Toru Yamakami, Shinagawa (JP)

(73) Assignee: Fujitsu Component Limited, Tokyo (JP)

( * ) Notice: Subject to any disclaimer, the term of this patent is extended or adjusted under 35 U.S.C. 154(b) by 0 days.

(21) Appl. No.: 12/845,059

(22) Filed: Jul. 28, 2010

(65) Prior Publication Data

US 2011/0028033 A1 Feb. 3, 2011

(30) Foreign Application Priority Data

Aug. 3, 2009 (JP) ..... 2009-180742

(51) Int. Cl.
*H01R 9/05* (2006.01)

(52) U.S. Cl. ..... 439/578; 439/581; 439/63

(58) Field of Classification Search ..... 439/578, 439/581, 580, 63, 607.46, 629, 59, 325
See application file for complete search history.

(56) References Cited

U.S. PATENT DOCUMENTS

| | | | | |
|---|---|---|---|---|
| 3,201,721 | A * | 8/1965 | Voelcker | 333/33 |
| 5,532,659 | A * | 7/1996 | Dodart | 333/260 |
| 6,705,875 | B2 * | 3/2004 | Berghorn et al. | 439/63 |
| 6,947,011 | B2 | 9/2005 | Kukita et al. | |
| 6,976,873 | B2 * | 12/2005 | Taguchi | 439/578 |
| 7,695,289 | B1 * | 4/2010 | Sato et al. | 439/78 |

FOREIGN PATENT DOCUMENTS

JP 2004-304313 10/2004

* cited by examiner

*Primary Examiner* — Hae Moon Hyeon
(74) *Attorney, Agent, or Firm* — IPUSA, PLLC

(57) ABSTRACT

A coaxial connector where a plug having a coaxial structure is connected in a direction substantially parallel with a board, the board being where the coaxial connector is mounted, the coaxial connector includes a signal contact having one end connected to a plug pin and another end bent or curved toward the board; and a ground contact having a substantially cylindrical shaped main body part, the main body part surrounding a part of the signal contact, the ground contact being connected to a plug side ground member by a first connecting part formed at one end of the main body part, the ground contact being connected to the board by a second connecting part formed at another end of the main body part, wherein the second connecting part includes a center member and an arm part.

5 Claims, 16 Drawing Sheets

(A)

(B)

COAXIAL CONNECTOR AND CONNECTOR DEVICE

CROSS-REFERENCE TO RELATED APPLICATIONS

This patent application is based upon and claims the benefit of priority of Japanese Patent Application No. 2009-180742 filed on Aug. 3, 2009, the entire contents of which are incorporated herein by reference.

BACKGROUND OF THE INVENTION

1. Field of the Invention

The present invention generally relates to coaxial connectors where coaxial plugs are connected and connector devices including the coaxial connectors. More specifically, the present invention relates to a coaxial connector mounted on a board and a connector device including the coaxial connector.

2. Description of the Related Art

Conventionally, a coaxial connector configured to transfer a signal or electric power has been widely used for a computer or between boards. It is normal practice that the coaxial connector is mounted on the board. One kind of the coaxial connector is where a plug is connected in a direction perpendicular to a plane surface of the board. Another kind of the coaxial connector is where the plug is oriented in a direction substantially the same as the plane surface of the board and is connected in a right angle direction. Connecting the plug oriented in the direction substantially the same as the plane surface of the board in the right angle direction is called a right angle connection. The coaxial connector which can make the right angle connection has been useful for an actual design and has been developed.

An invention of a connector unit for a high frequency radio which realizes the right angle connection has been discussed in, for example, Japanese Laid-Open Patent Application Publication No. 2004-304313. This connector unit includes a movable contact and a fixed contact. In a state where a signal contact of a plug is inserted, only the movable contact is connected with the plug and an external antenna is used. In a state where the signal contact of the plug is not inserted, the movable contact and the fixed contact are connected and an internal antenna is used.

However, in the connector unit described in Japanese Laid-Open Patent Application Publication No. 2004-304313, a contact part is fixed by solder or the like. Hence, repairing or maintenance of the connector unit may be difficult. In addition, a ground contact does not sufficiently surround a signal contact. Therefore, characteristic impedance in the signal transmission may be high so that it may be difficult to achieve impedance matching. In addition, since there is no means by which a signal transmission path of the ground contact can be made sufficiently wide, it may be difficult to correspond to a high speed (high frequency) signal transmission.

SUMMARY OF THE INVENTION

Accordingly, embodiments of the present invention may provide a novel and useful coaxial connector and connector device including the coaxial connector solving one or more of the problems discussed above.

More specifically, the embodiments of the present invention may provide a coaxial connector whereby removal from a board or impedance matching can be easily achieved and which can correspond to high speed transmission and a connector device including the coaxial connector.

Another aspect of the embodiments of the present invention may be to provide a coaxial connector where a plug having a coaxial structure is connected in a direction substantially parallel with a board, the board being where the coaxial connector is mounted, the coaxial connector including:

a signal contact having one end connected to a plug pin and another end bent or curved toward the board; and a ground contact having a substantially cylindrical shaped main body part, the main body part surrounding a part of the signal contact, the ground contact being connected to a plug side ground member by a first connecting part formed at one end of the main body part, the ground contact being connected to the board by a second connecting part formed at another end of the main body part, wherein the second connecting part includes a center member surrounding two or more surfaces of the signal contact, the center member having a hole part pierced by the bent or curved portion of the signal contact, the center member having a cross section of a substantially rectangular shape without one side; and an arm part extending from a side part of the center member, the arm part having an end part separated from and facing a head end part of the center member, wherein the end part of the arm part comes in contact with the head end part of the center member by fixing a housing to the board so that a part of the arm part is pressed and makes contact with an electrode of the board due to an elastic force generated at the arm part.

Another aspect of the embodiments of the present invention may be to provide a connecting device, including the above-mentioned coaxial connector, and a plug having the plug side ground member connected to the ground contact due to an elastic restoring force.

According to the embodiment of the present invention, it is possible to provide a coaxial connector whereby removal from a board or impedance matching can be easily achieved and which can correspond to high speed transmission, and a connector device including the coaxial connector.

Additional objects and advantages of the embodiments are set forth in part in the description which follows, and in part will become obvious from the description, or may be learned by practice of the invention. The object and advantages of the invention will be realized and attained by means of the elements and combinations particularly pointed out in the appended claims. It is to be understood that both the foregoing general description and the following detailed description are exemplary and explanatory and are not restrictive of the invention as claimed.

DETAILED DESCRIPTION OF THE PREFERRED EMBODIMENTS

A description is given below, with reference to FIG. 1 through FIG. 16 of embodiments of the present invention.

Figure 1:
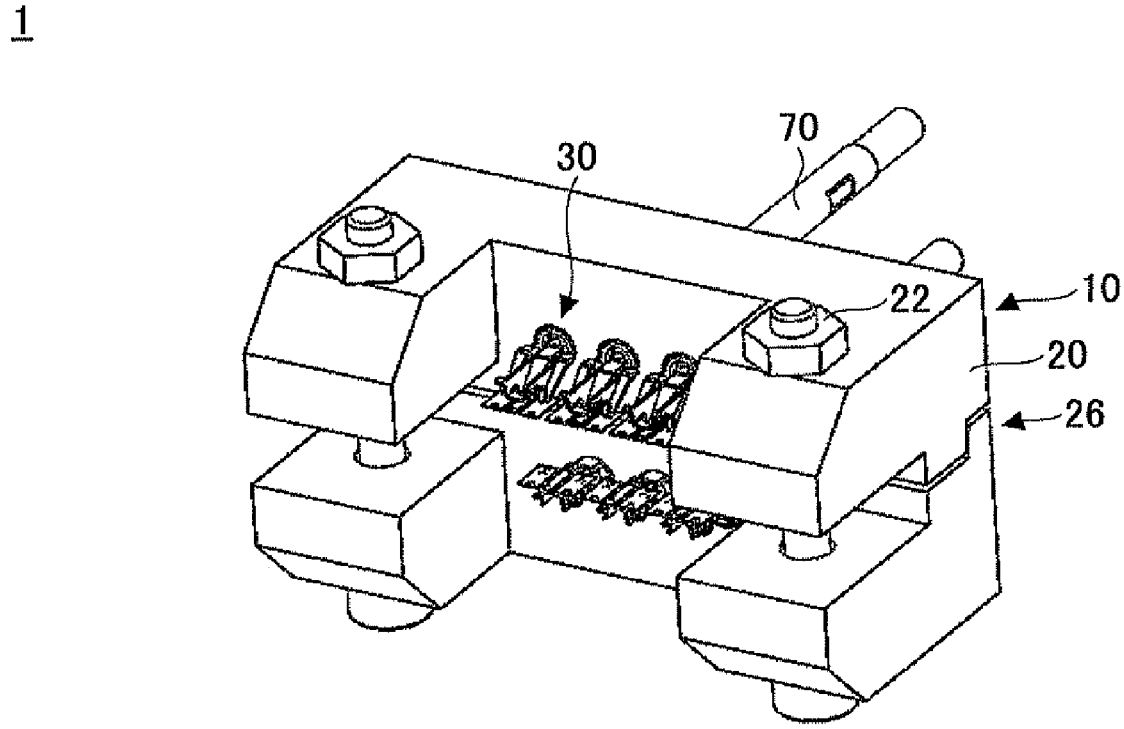
FIG. 1 is a perspective view of a connector device 1 of an embodiment of the present invention.
Figure 2:
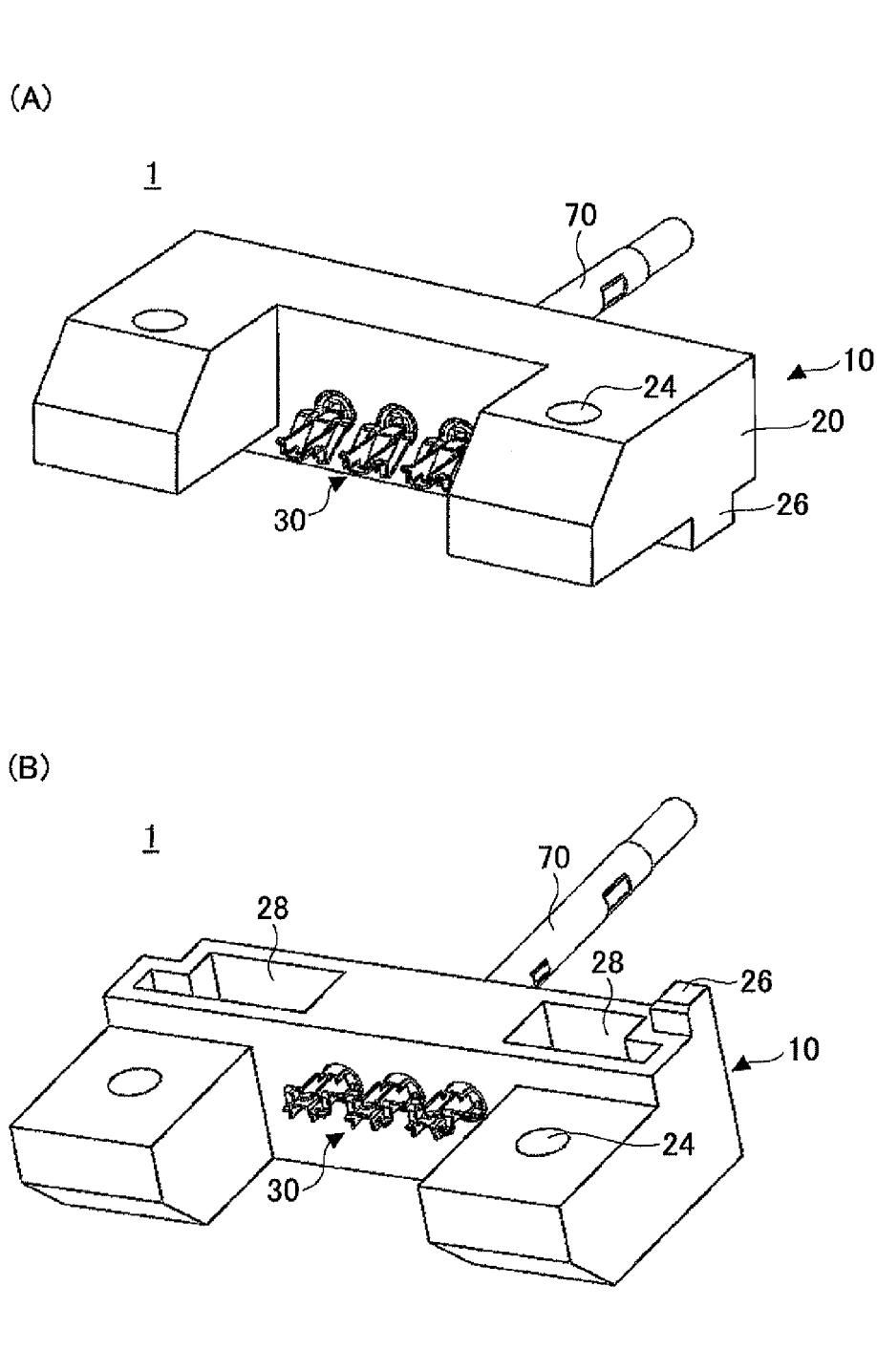
FIG. 2 is a perspective view of two axial connectors 10 used as a set.

First a connector device 1 of the embodiment of the present invention is discussed. FIG. 1 is a perspective view of the connector device 1 of the embodiment of the present invention. The connector device 1 includes a coaxial connector 10 and a plug 70.

A pair of the coaxial connectors 10, as a set, is used and mounted on a board 100 (see FIG. 4) discussed below so as to sandwich the board 100.

FIG. 2(A) and FIG. 2(B) are perspective views of each of coaxial connectors 10 used as the set. The plug 70 is inserted in the coaxial connector 10 so that the plug 70 and the board 100 are electrically connected to each other. A single coaxial connector 10 may be mounted on the board 100.

The coaxial connector 10 includes a housing 20 and plural contacts 30 provided at the housing 20.

The housing 20 is a molded product made of thermoplastic resin such as LCP (liquid crystal polymer). The housing 20 includes piercing holes 24 (see FIG. 2) where bolts 22 are inserted when the coaxial connector 10 is mounted on the board 100. The housing 20 also includes plural piercing holes where the contacts 30 are provided. A single set of the contacts 30 is provided in a single piercing hole. In addition, the housing 20 includes a positioning step 26, hole parts 28, and others (see FIG. 2).

Each of the contacts 30 corresponds to a coaxial plug 70 to be connected. The contact 30 includes a signal contact 40 (see FIG. 6) and a ground contact 50 (see FIG. 5).

Figure 3:
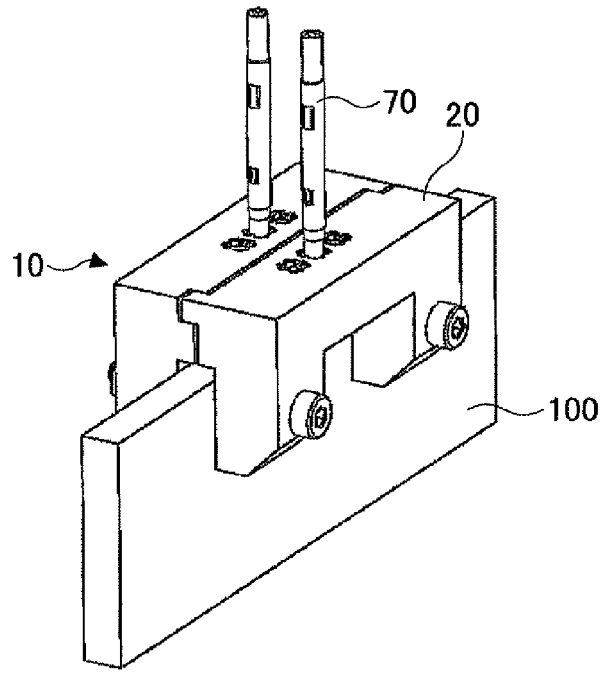
FIG. 3 is a perspective view of a state where the connector device 1 is mounted on a board 100 seen from two different directions.
Figure 3:
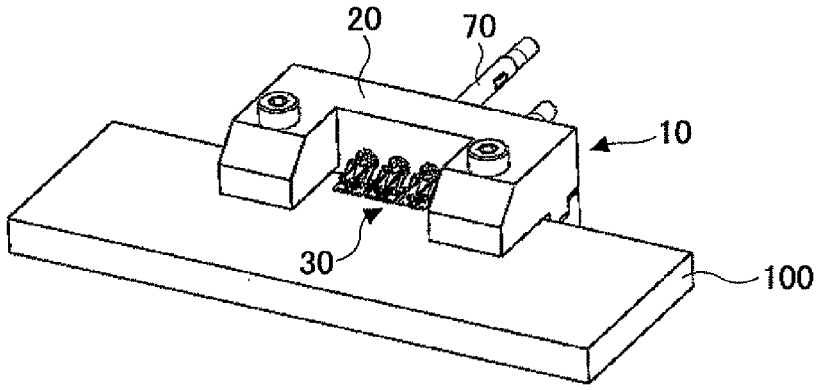

FIG. 3(A) and FIG. 3(B) are perspective views of the state where the connector device 1 is mounted on a board 100 seen from two different directions. As shown in FIG. 3, in the connector device 1, the plug 70 having a coaxial structure is connected to the coaxial connector 10 in a direction substantially parallel with the board 100 where the connector device 1 is mounted (right angle connection).

Figure 4:
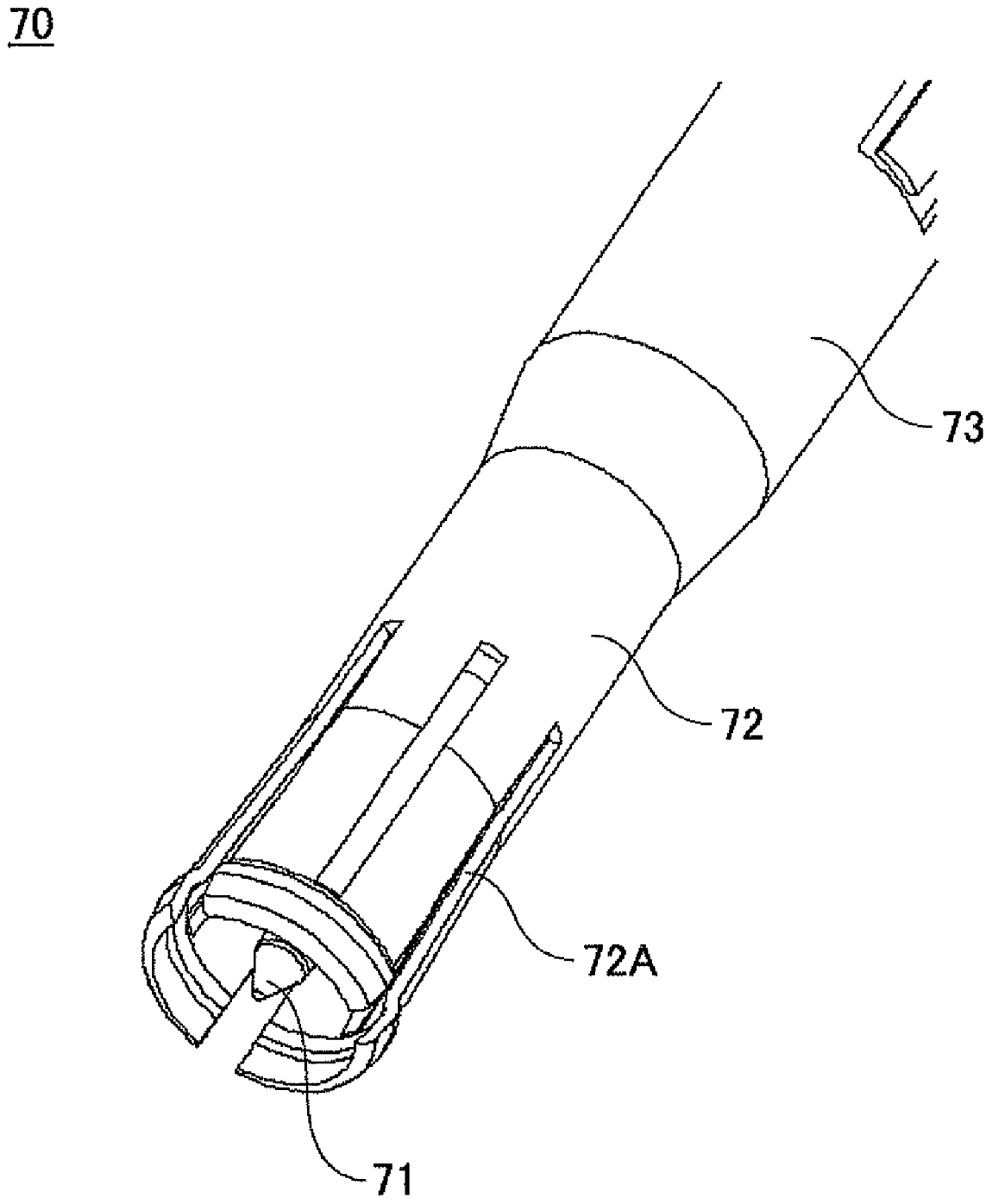
FIG. 4 is a perspective view of a part of the plug 70.

First, the plug 70 is discussed. FIG. 4 is a perspective view of a part of the plug 70. FIG. 4 shows the plug 70 where the coaxial cable is connected. The plug 70 includes a plug pin 71, a ground member 72, an insulator 73, and other parts. More specifically, the plug pin 71 is press fitted into a small hole piercing the insulator 73. The insulator 73 is press fitted onto the cylindrical shaped ground member 72.

The coaxial cable has a structure where a copper core line which is a signal line situated in a center position, an insulator made of resin, a shield line made of a braided wire, and a protection film made of resin are stacked in this order. The copper core line of the coaxial cable is connected to the plug pin 71. The shield line is connected to the ground member 72.

As shown in FIG. 4, plural slits 72A are formed in the ground member 72 from a head end toward a base part of the ground member 72. Therefore, the ground member 72 has a configuration where the head end of the ground member 72 is divided into plural parts (for example, into three parts). Because of this configuration, the ground member 72 is pressed from an outside of the ground member 72 toward the plug pin 71 so as to be able to be elastically deformed toward the plug pin 71.

Figure 5:
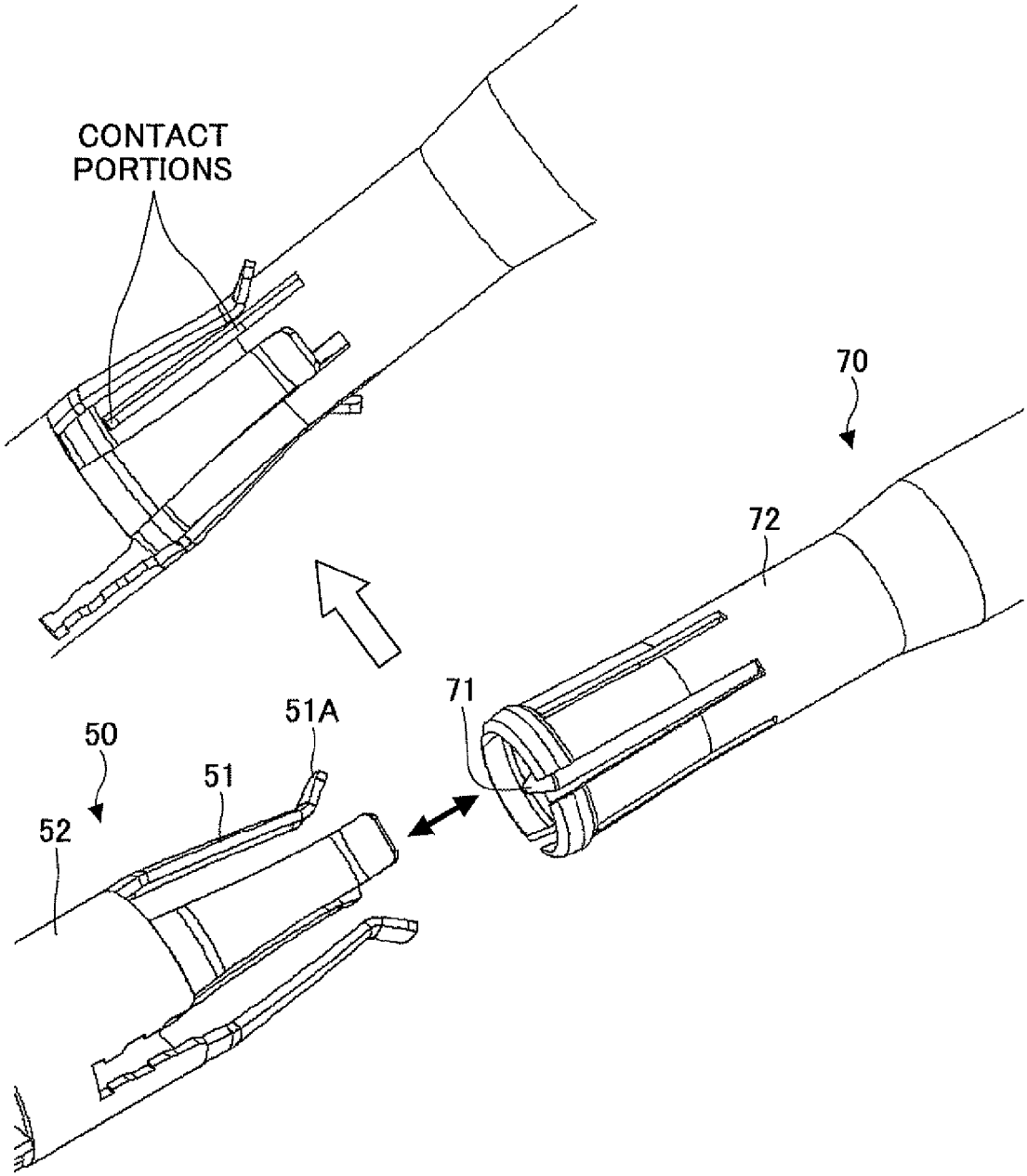
FIG. 5 is a view where the plug 70 is inserted into the coaxial connector 10.

FIG. 5 is a view where the plug 70 is inserted into the coaxial connector 10. As shown in FIG. 5, the ground member 72 of the plug 70 is inserted into a ground contact 50 so as to be situated inside a first connecting part 51 of the ground contact 50.

The ground contact 50 is made of a contact material such as phosphor bronze. The ground contact 50 includes the first connecting part 51 and a second connecting part 53 (see FIG. 7). The first connecting part 51 is provided at one end of a cylindrical shaped main part 52 and is configured to connect to the ground member 72. The second connecting part 53 is provided at another end of a cylindrical shaped main part 52 and is configured to connect to the board 100.

The first connecting part 51 of the ground contact 50 is divided into four parts extending from, for example, the main part 52. The head end of the first contacting part 51 is bent outwardly so that a guide part 51A is formed. By the guide part 51A, the ground member 72 of the plug 70 can be easily inserted into the ground contact 50. In addition, the first connecting part 51 of the ground contact 50 is pressed from an inside of the first connecting part 51 by the ground member 72 of the plug 70 so as to be able to be elastically deformed outwardly.

With this structure, when the plug 70 is inserted into the coaxial connector 10, the ground member 72 of the plug 70 is elastically deformed inwardly and the first connecting part 51 of the ground contact 50 is elastically deformed outwardly. By restoring forces of the ground member 72 of the plug 70 and the first connecting part 51 of the ground contact 50, the plug 70 and the coaxial connector 10 are stably fixed to each other.

At this time, the first connecting part 51 of the ground contact 50 comes in contact with the ground member 72 of the plug 70 at two portions, namely a head end and a base side so as to be electrically connected to the ground member 72 of the plug 70. Because of this, it is possible to prevent a stub from being formed at a ground signal transmission path so that mixture of noise in a high frequency transmission can be prevented.

Figure 6:
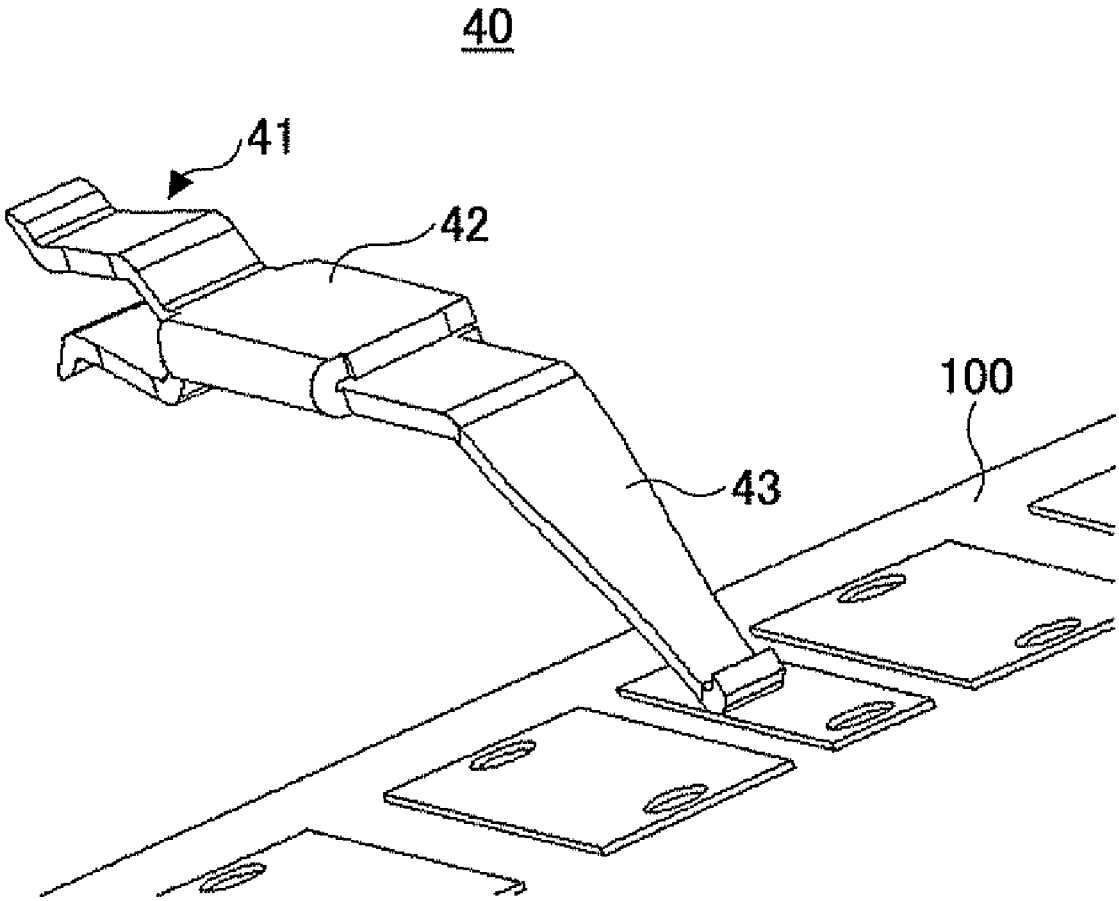
FIG. 6 is a perspective view of a signal contact with the board.

Next, a signal contact 40 is discussed. FIG. 6 is a perspective view of the signal contact 40 with the board 100. FIG. 6 shows a status where the ground contact 50 surrounding a part of the signal contact 40 is not depicted.

The signal contact 40 includes a first connecting part 41 and a second connecting part 43. The first connecting part 41 is formed at one end of a main body part 42. The second connecting part 43 is formed at another end of the main body part 42.

The first connecting part 41 is configured to sandwich the plug pin 71 of the plug 70 (see FIG. 4) from both sides so as to be connected to the plug pin 71. The second connecting part 43 is bent toward the board 100. The substantially same material of the ground contact 50 may be used as a material of the signal contact 40.

The first connecting part 41 of the signal contact 40 may not have a fork-shaped configuration as shown in FIG. 6 but may have a bellows-shaped configuration. In addition, the second connecting part 43 of the signal contact 40 may have a configuration curved toward the board 100.

Figure 7:
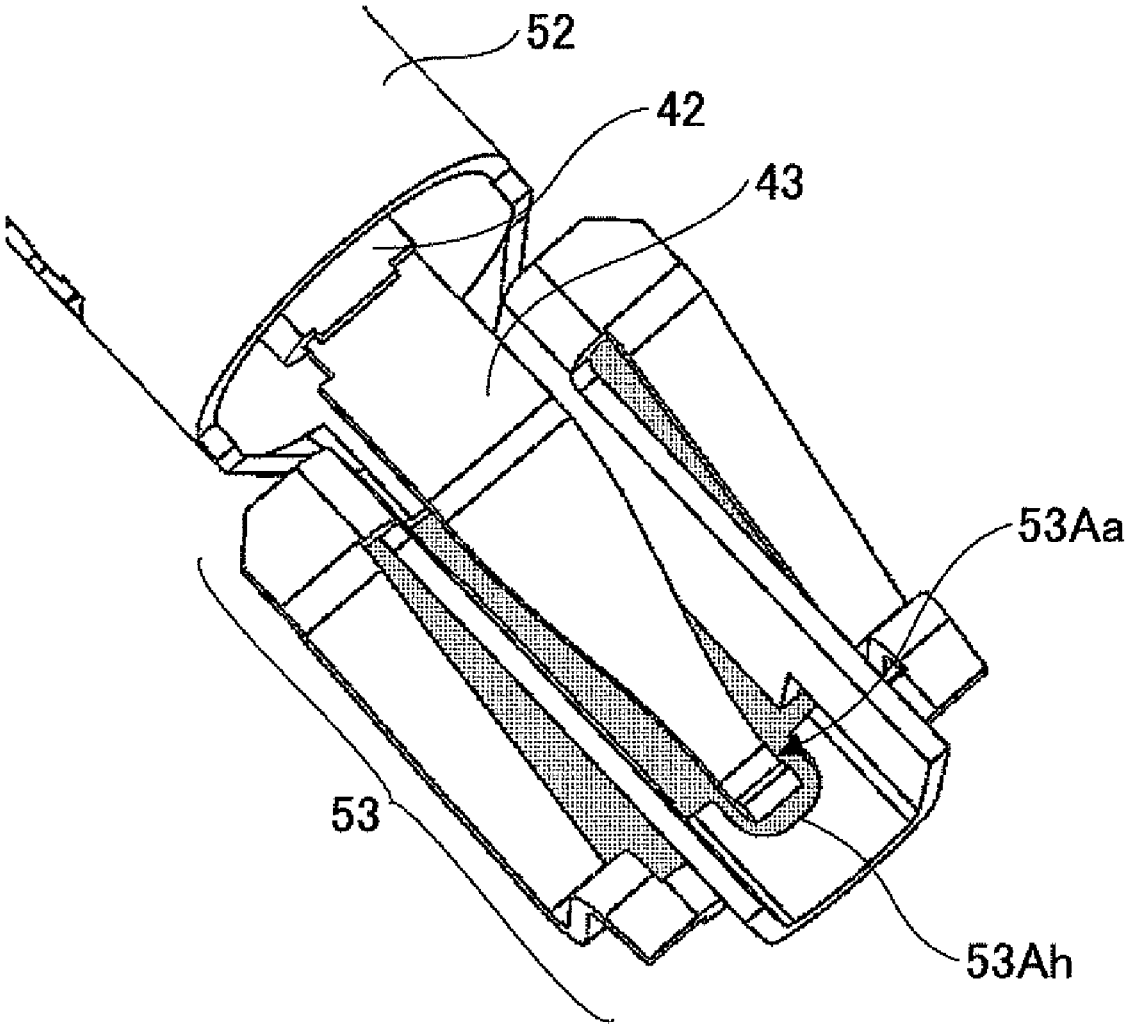
FIG. 7 is a perspective view showing a state where the signal contact 40 and a ground contact 50 are combined.

FIG. 7 is a perspective view showing a state where the signal contact 40 and the ground contact 50 are combined. In the signal contact 40, the first connecting part 41 is surrounded by the first connecting part 51 of the ground contact 50. The main part 42 is received in the substantially circular-shaped main part 52 of the ground contact 50.

In addition, three sides, namely left and right sides and a bottom side (side where the substrate 100 is provided) of the second connecting part 43 of the signal contact 40 are surrounded by the second connecting part 53 of the ground contact 50 having the above-mentioned structure. The second connecting part 43 of the signal contact 40 projects, via a piercing part 53Aa formed in the second connecting part 53 of the ground contact 50, toward the board 100.

Here, a structure of the second connecting part 53 of the ground contact 50 surrounding the three sides of the second connecting part 43 of the signal contact 40 is discussed. FIG. 8(A) and FIG. 8(B) are perspective views of the second connecting part 53 of the ground contact 50 seen from two different directions. FIG. 8(A) shows a surface side (a side opposite to the side connected to the board 100) of the second connecting part 53 of the ground contact 50. FIG. 8(B) shows a rear surface side (the side connected to the board 100) of the second connecting part 53 of the ground contact 50.

As shown in FIG. 8(A), the second connecting part 53 of the ground contact 50 includes a center member 53A and arm parts 53B and 53C. The center member 53A has a cross section whose configuration has a rectangular shape without one side. The arm parts 53B and 53C extend from side parts of the center member 53A.

In the center member 53A, a bottom plate part 53Ab, side wall parts 53Ac and 53Ad, and a head end connecting part 53Ag are formed in a body. The bottom plate part 53Ab extends from the main body part 52 of the ground contact 50 so as to face the second connecting part 53 of the ground contact 50. The side wall parts 53Ac and 53Ad extend and are bent from corresponding sides of the bottom plate part 53Ab. By the head end connecting part 53Ag, the side wall parts 53Ac and 53Ad are connected to each other in the vicinity of the head end of the center member 53A. A concave part 53Ab is formed in the head end connecting part 53Ag where the second connecting part 43 of the signal contact 40 passes.

The arm parts 53B and 53C extend and are bent from the side wall parts 53Ac and 53Ad of the center member 53A. The arm parts 53B and 53C are formed to extend along the center member 53A in a head end direction (which is a direction opposite to a direction indicated by an arrow in FIG. 8) and are bent (curved) in the same direction as the second connecting part 43 of the signal contact 40 so as to project and thus border connecting parts 53Ba and 53Ca configured to be connected to the board 100.

The configuration of the second connecting part 53 of the ground contact 50 discussed above is made by stamping a plate member as a base member by pressing and then bending the plate member to form the designated configuration.

Figure 8:
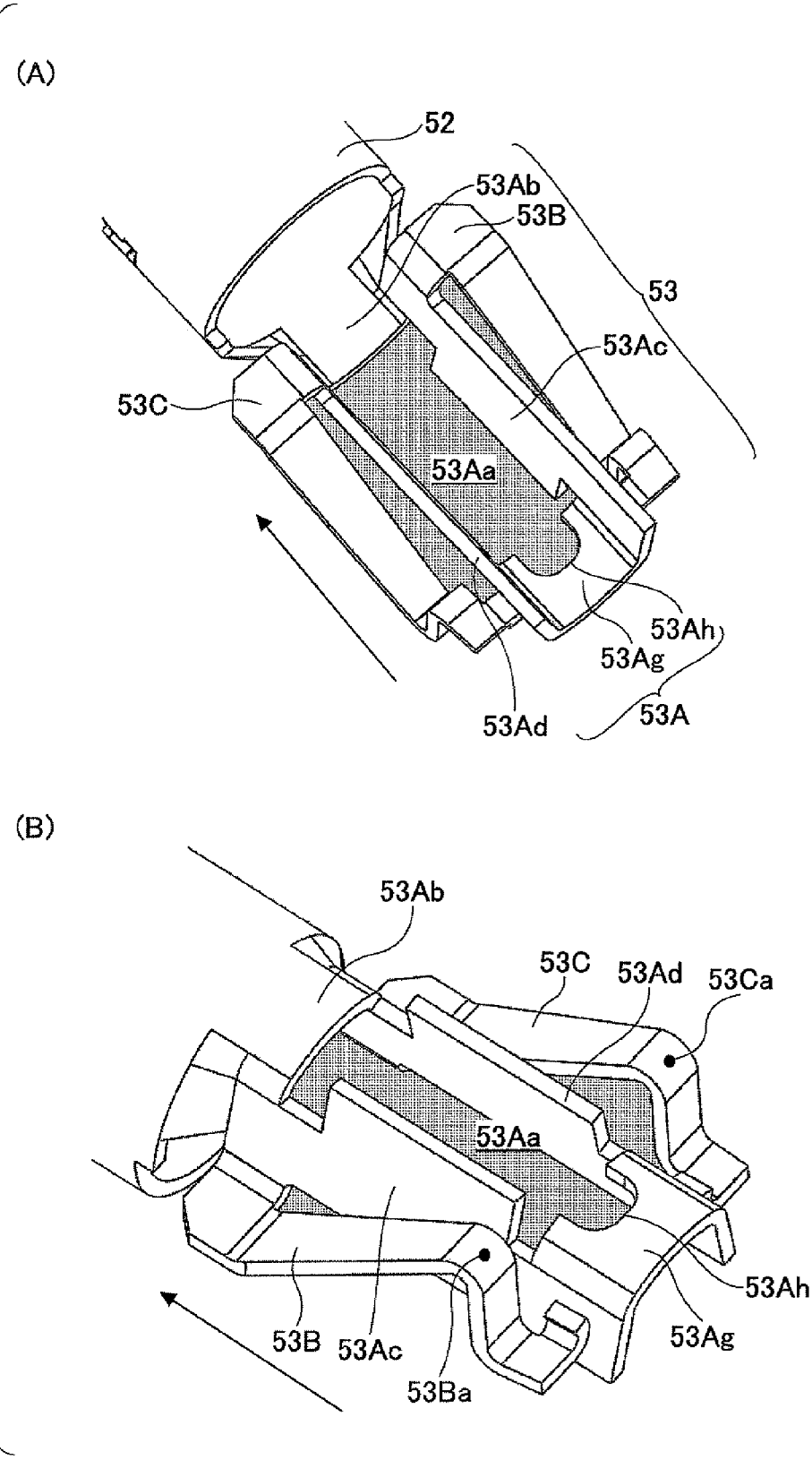
FIG. 8 is perspective view of a second connecting part 53 of the ground contact 50 seen from two different directions.
Figure 9:
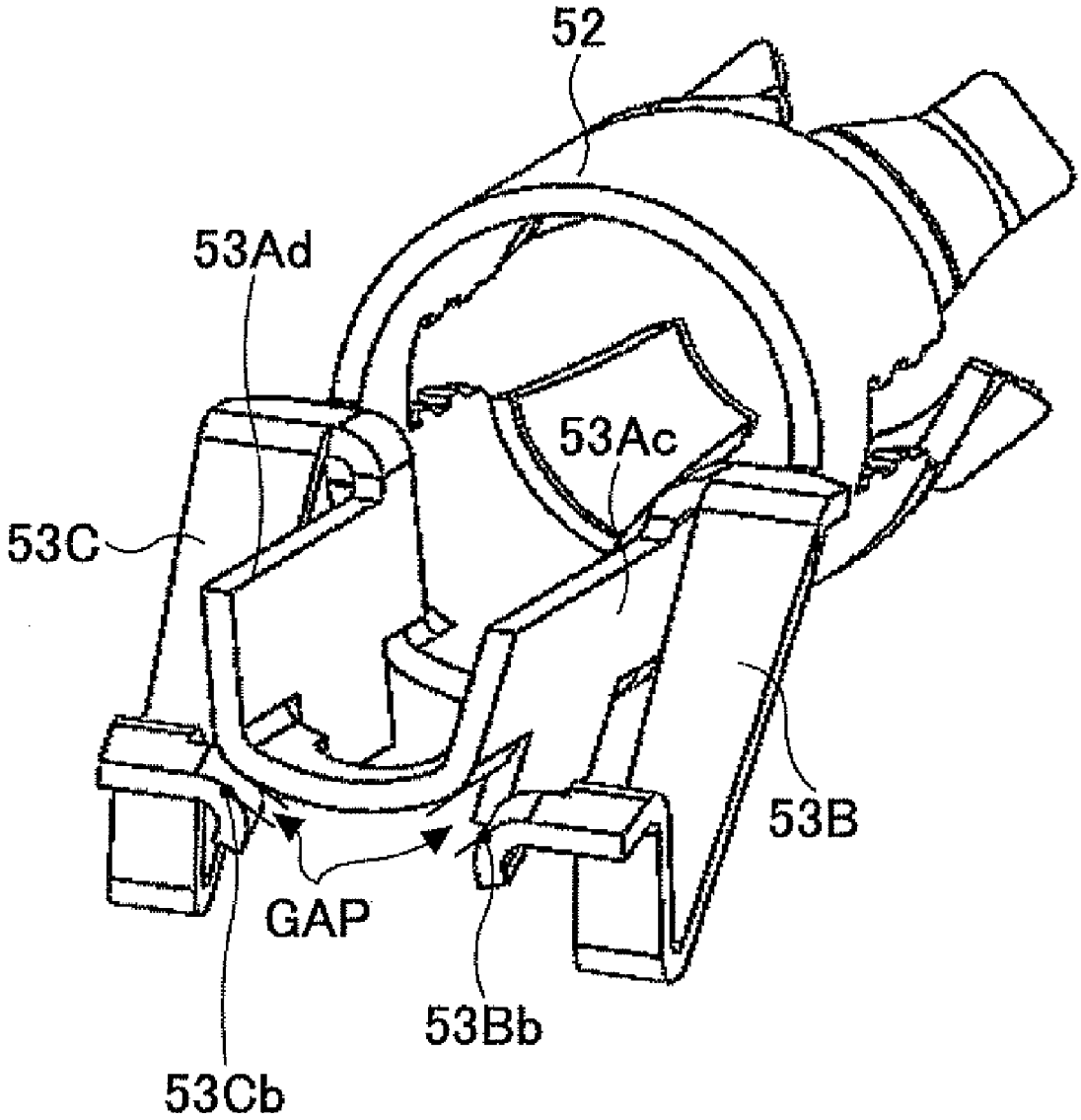
FIG. 9 is a perspective view of the second connecting part 53 of the ground contact 50 seen from a direction indicated by an arrow in FIG. 8.

FIG. 9 is a perspective view of the second connecting part 53 of the ground contact 50 seen from a direction indicated by an arrow in FIG. 8.

As shown in FIG. 9, end parts 53Bb and 53Cb of the arm parts 53B and 53C are formed so as to be separated and face head end parts of the side wall parts 53Ac and 53Ad of the center member 53A in a state where the external force is not applied. As discussed below, if the coaxial connector 10 is pushed toward the board 100, the end parts 53Bb and 53Cb of the arm parts 53B and 53C come in contact with the head end parts of the side wall parts 53Ac and 53Ad of the center member 53A.

Figure 10:
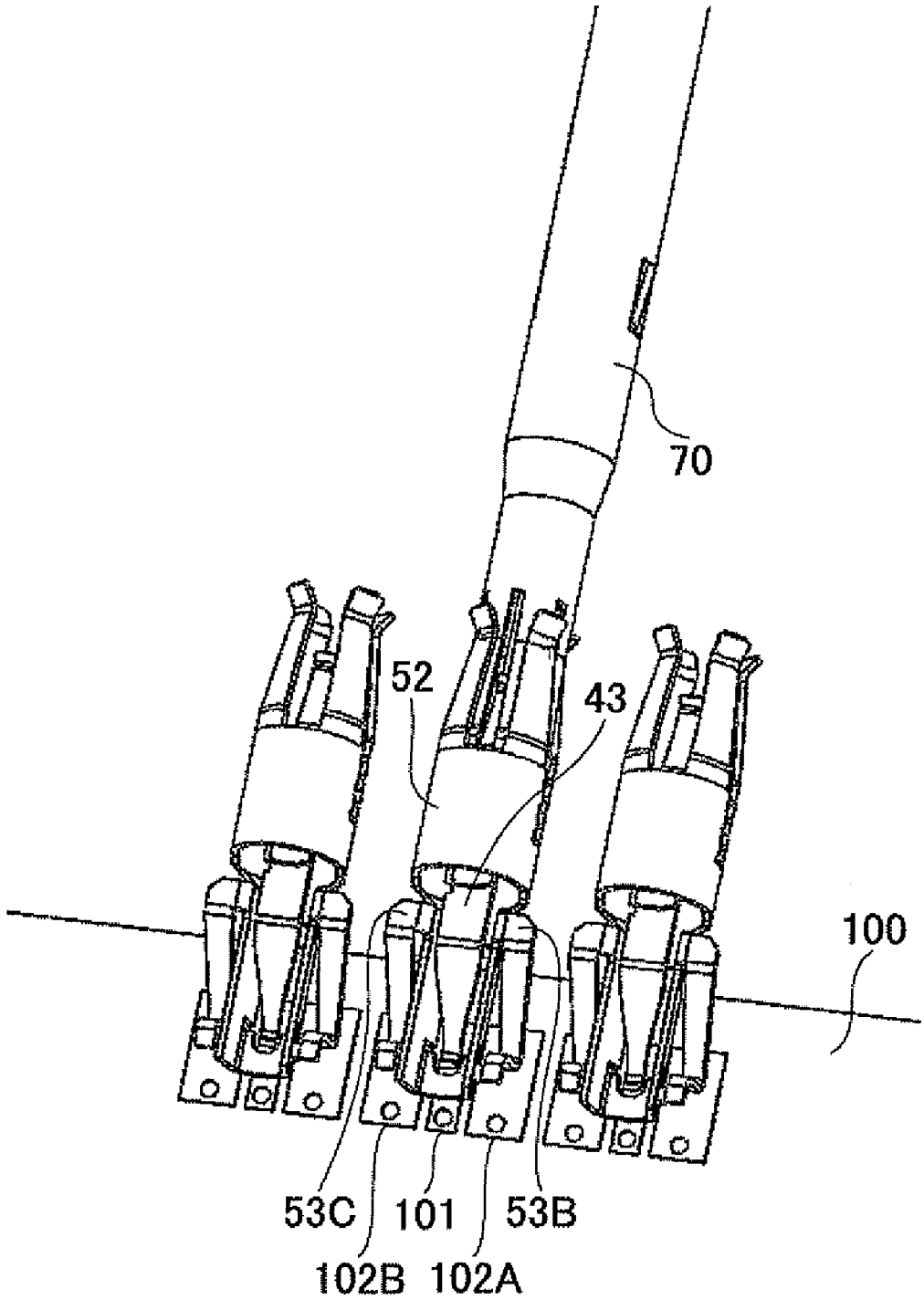
FIG. 10 is a view showing a state where the contact 30 of the axial connector 10 is connected to the board 100.
Figure 11:
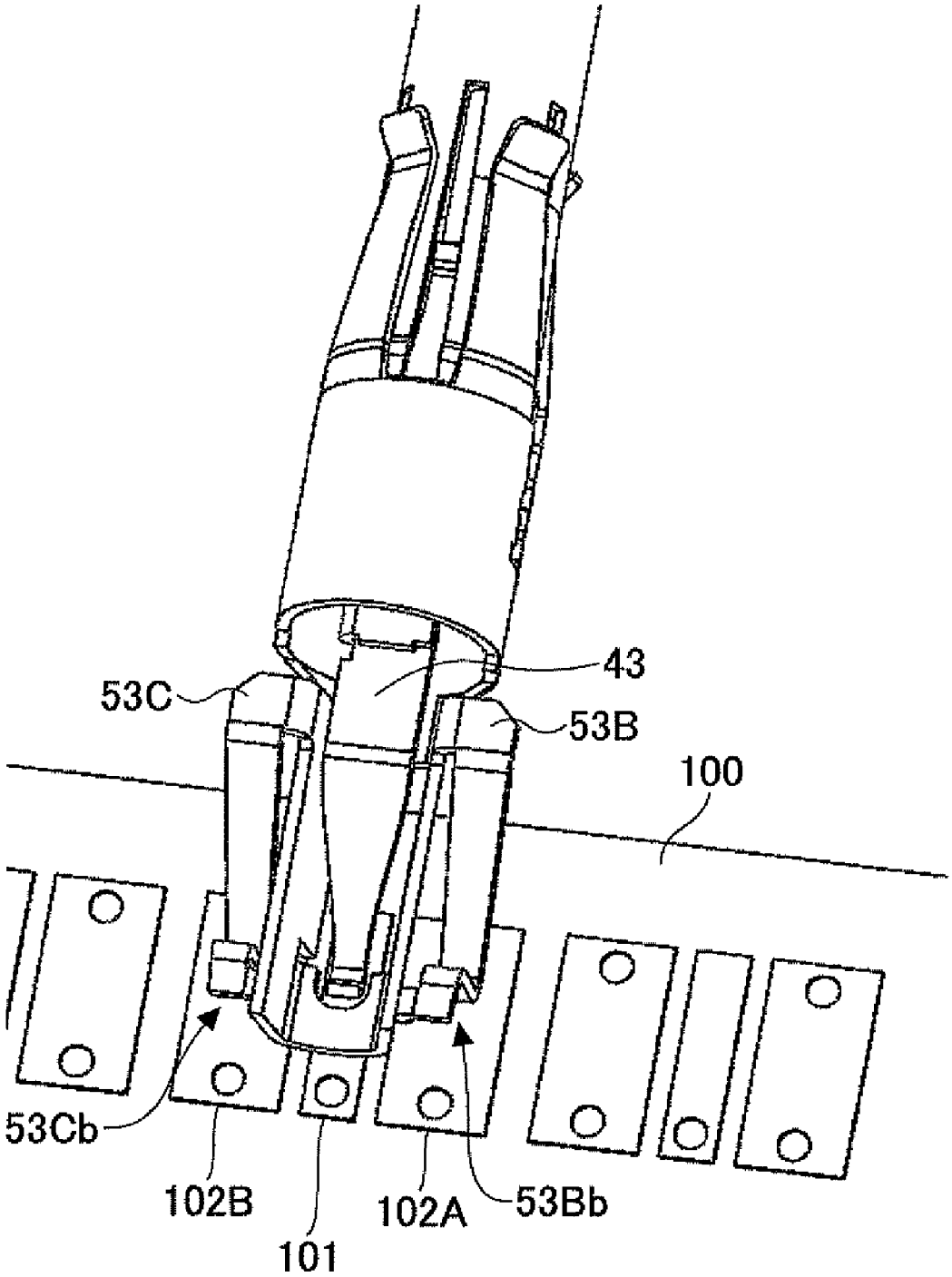
FIG. 11 is an expanded view showing the state where the contact 30 of the axial connector 10 is connected to the board 100.

The contacts 30 of the coaxial connector 10 having the above-discussed structure are connected to the board 100 as shown in FIG. 10 and FIG. 11.

Figure 12:
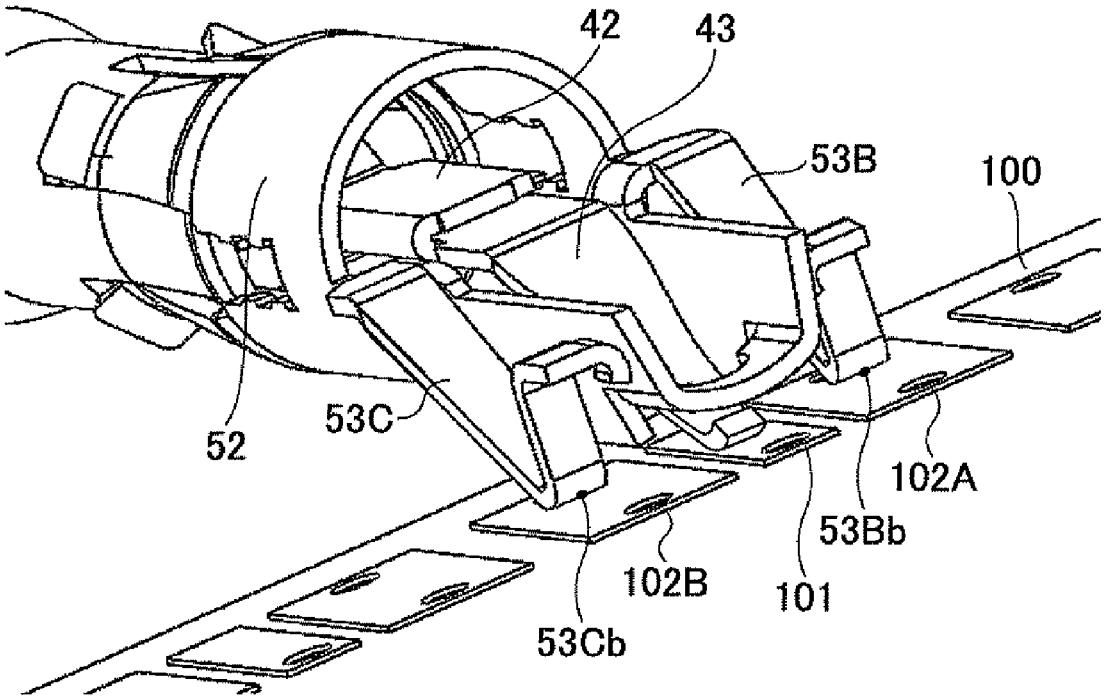
FIG. 12 is an expanded view showing the state where the contact 30 of the axial connector 10 is connected to the board 100, seen in a direction different from that of FIG. 11.

FIG. 10 is a view showing a state where the contacts 30 of the axial connector 10 are connected to the board 100. FIG. 11 is an expanded view showing the state where the contacts 30 of the axial connector 10 are connected to the board 100. FIG. 12 is an expanded view showing the state where the contacts 30 of the axial connector 10 are connected to the board 100, seen in a direction different from FIG. 11.

As shown in FIG. 10, the coaxial connector 10 is connected to the board 100 in a state where the coaxial connector 10 lays on the board 100 so that the right angle connection can be made. The second connecting part 43 of the signal contact 40 and the board connecting parts 53Ba and 53Ca of the arm parts 53B and 53C of the ground contact 50 are arranged in series. Similarly, a signal terminal 101 and ground terminals 102A and 102B of the board 100 are arranged in series. The second connecting part 43 of the signal contact 40 is connected to the signal terminal 101 of the board 100. The board connecting parts 53Ba and 53Ca of the arm parts 53B and 53C of the ground contact 50 are connected to the ground terminals 102A and 102B of the board 100. With this structure, it is possible to realize high densification of the board.

By pushing the housing 20 toward the board 100, the second connecting part 43 of the signal contact 40 and the arm parts 53B and 53C of the ground contact 50 are pressed to the board 100. When the housing 20 is fixed to the board 100 by the bolts 22 or the like, by the elastic restoring force, the second connecting part 43 of the signal contact 40 and the arm parts 53B and 53C of the ground contact 50 are pressed to and make contact with the signal terminal 101 and the ground terminals 102A and 102B of the board 100. As a result of this, the second connecting part 43 of the signal contact 40 and the arm parts 53B and 53C of the ground contact 50 are stably connected to the signal terminal 101 and the ground terminals 102A and 102B of the board 100.

As a result of this, the signal line (core line) of the cable is electrically connected to the signal terminal 101 of the board 100 via the signal contact 40 so that the signal transmission is performed. In addition, the shield line of the cable is connected to the ground terminals 102A and 102B of the board 100 via the ground contact 50 so that ground connection is made. In the coaxial connector 10 of the embodiment of the present invention, since it is not necessary to perform soldering or the like to connect the coaxial connector 10 to the board 100, it is possible to easily remove the coaxial connector 10 from the board 100 so that repairing or maintenance can be easily performed.

Next, a structure of the second connecting part 53 of the ground contact 50 is further discussed. As shown in FIG. 9, end parts 53Bb and 53Cb of the arm parts 53B and 53C are formed so as to be separated and face head end parts of the side wall parts 53Ac and 53Ad of the center member 53A in a state where the external force is not applied (where the housing 20 is not attached to the board 100).

Figure 13:
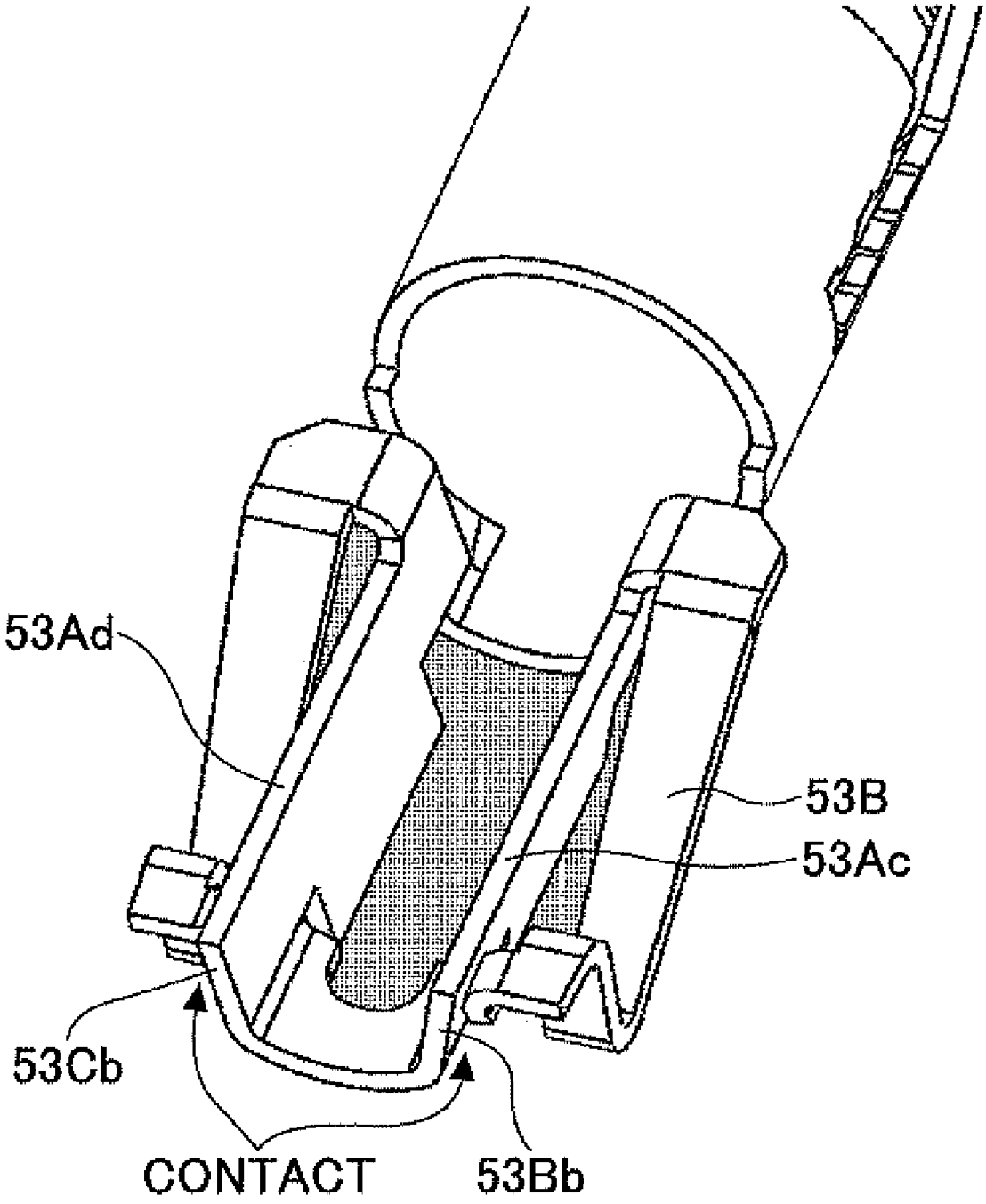
FIG. 13 is a view showing a state where a housing 20 is provided at the board 100 so that an external force is applied to end parts 53Bb and 53Cb of arm parts 53B and 53C.

FIG. 13 is a view showing where the housing 20 is attached to the board 100 so that an external force is applied to end parts 53Bb and 53Cc of arm parts 53B and 53C. As shown in FIG. 13, the end parts 53Bb and 53Cb of the arm parts 53B and 53C come in contact with the head end parts of the side wall parts 53Ac and 53Ad of the center member 53A so that electric connection is made.

Figure 14:
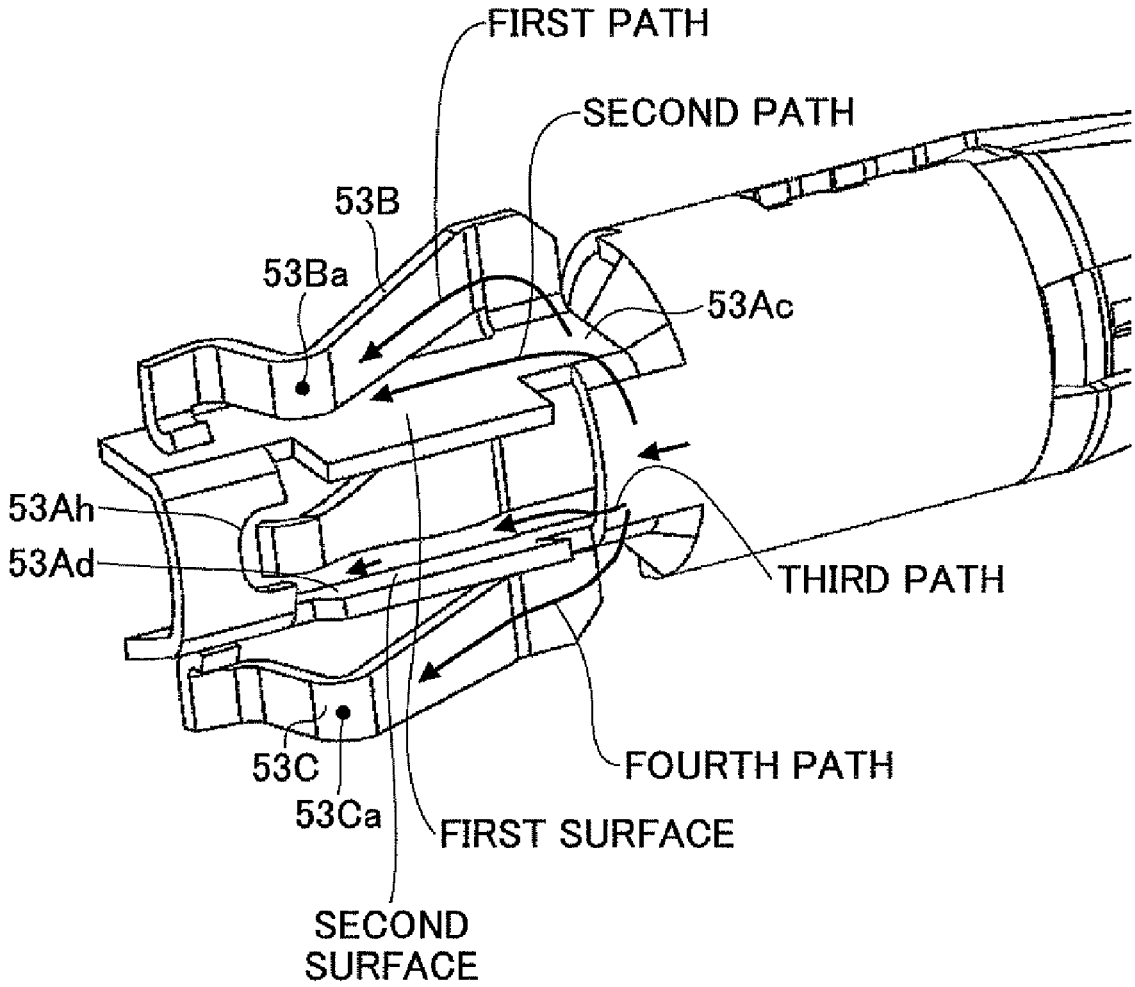
FIG. 14 is a view of the contact provided at the board 100 seen from a bottom side (a side where the board 100 is provided)

FIG. 14 is a view of the contact provided at the board 100 seen from a bottom side (the side where the board 100 is provided).

In the coaxial connector 10 of the embodiment of the present invention, since the first connecting part 41 and the main body part 42 of the signal contact 40 are surrounded by the first connecting part 51 and the main part 52 of the ground contact 50, it is possible to prevent disturbance from entering the plug pin 71 and the signal contact 30.

The second connecting part 43 of the signal contact 40 is surrounded by two surfaces (three surfaces if the bottom plate part 53Ab is included), a first surface formed by the side wall part 53Ac of the ground contact 50 and a second surface formed by a side wall part 53Ad. Therefore, in the embodiment of the present invention compared to a case where a member of the signal contact projecting to the board side is not surrounded by the ground member, it is possible to more effectively prevent the entry of the disturbance into the plug pin 71 and the signal contact 30.

In addition, the ground contact 50 is close to the signal contact 40 along the entirety of the signal contact 40. Therefore, it is possible to easily achieve impedance matching of the signal contact 40. As a result of this, impedance matching of the coaxial connector 10 can be easily achieved.

Furthermore, as shown in FIG. 14, plural ground transmission paths are provided in the coaxial connector 10 of the embodiment of the present invention. In other words, at least four paths are provided in this embodiment. The first path is from the bottom plate part 53Ab to the board connecting part 53Ba via the side wall part 53Ac and the arm part 53B. The second path is from the bottom plate part 53Ab to the board connecting part 53Ba via the side wall part 53Ac and the head end connecting part 53Ag. The third path is from the bottom plate part 53Ab to the board connecting part 53Ca via the side wall part 53Ad and the arm part 53C. The fourth path is from the bottom plate part 53Ab to the board connecting part 53Ca via the side wall part 53Ad and the head end connecting part 53Ag. Because of this, it is possible to easily achieve the impedance matching of the ground contact 50. As a result of this, the impedance matching of the coaxial connector 10 is easily achieved. Furthermore, it is possible to prevent noise from entering at the time of high speed transmission.

In the coaxial connector 10 of the embodiment of the present invention discussed above, since the contact member is stably connected to the board without soldering, it is possible to easily perform repairing and maintenance.

Even if the mounting error is generated when the signal contact 40 and the ground contact 50 are provided at the housing 20 or even if a manufacturing error is generated in the housing 20, the signal contact 40, the ground contact 50, and other parts, such error is cancelled by elastic deformation of the second connecting part 43 of the signal contact or the arm parts 53B and 53C of the ground contact 50.

Furthermore, since the contact points are in pressing contact, it is possible to precisely achieve electric connection. Because of this, it is possible to improve the connection reliability between the coaxial connector 10 and the board 100.

In addition, the second connecting part 43 of the signal contact 40 is surrounded by two or more surfaces, so that it is possible to effectively prevent disturbance from entering into the plug pin 71 and the signal contact 30. Hence, it is possible to easily achieve the impedance matching of the coaxial connector 10.

Furthermore, since plural of the ground transmission paths are provided, it is possible to achieve the impedance matching of the ground contact 50. Hence, it is possible to prevent noise from entering at the time of high speed transmission.

Thus, according to the embodiments of the present invention, it is possible to provide a coaxial connector whereby removal from a board or impedance matching can be easily performed and which can correspond to high speed transmission and a connector device including the coaxial connector.

In the connector device 1 of the embodiment of the present invention, two parts, namely the head end and the base side, of the first contact part 51 of the ground contact 50 come in contact with the ground member 72 of the plug 70 so that the first connecting part 51 of the ground contact 50 and the ground member 72 of the plug 70 are electrically connected to each other. Hence, it is possible to prevent a stub from being formed at a ground signal transmission path so that mixture of noise can be prevented in a high frequency transmission.

All examples and conditional language recited herein are intended for pedagogical purposes to aid the reader in understanding the invention and the concepts contributed by the inventor to furthering the art, and are to be construed as being without limitation to such specifically recited examples and conditions, nor does the organization of such examples in the specification relate to a showing of the superiority or inferiority of the invention. Although the embodiments of the present invention have been described in detail, it should be understood that the various changes, substitutions, and alterations could be made hereto without departing from the spirit and scope of the invention.

Figure 15:
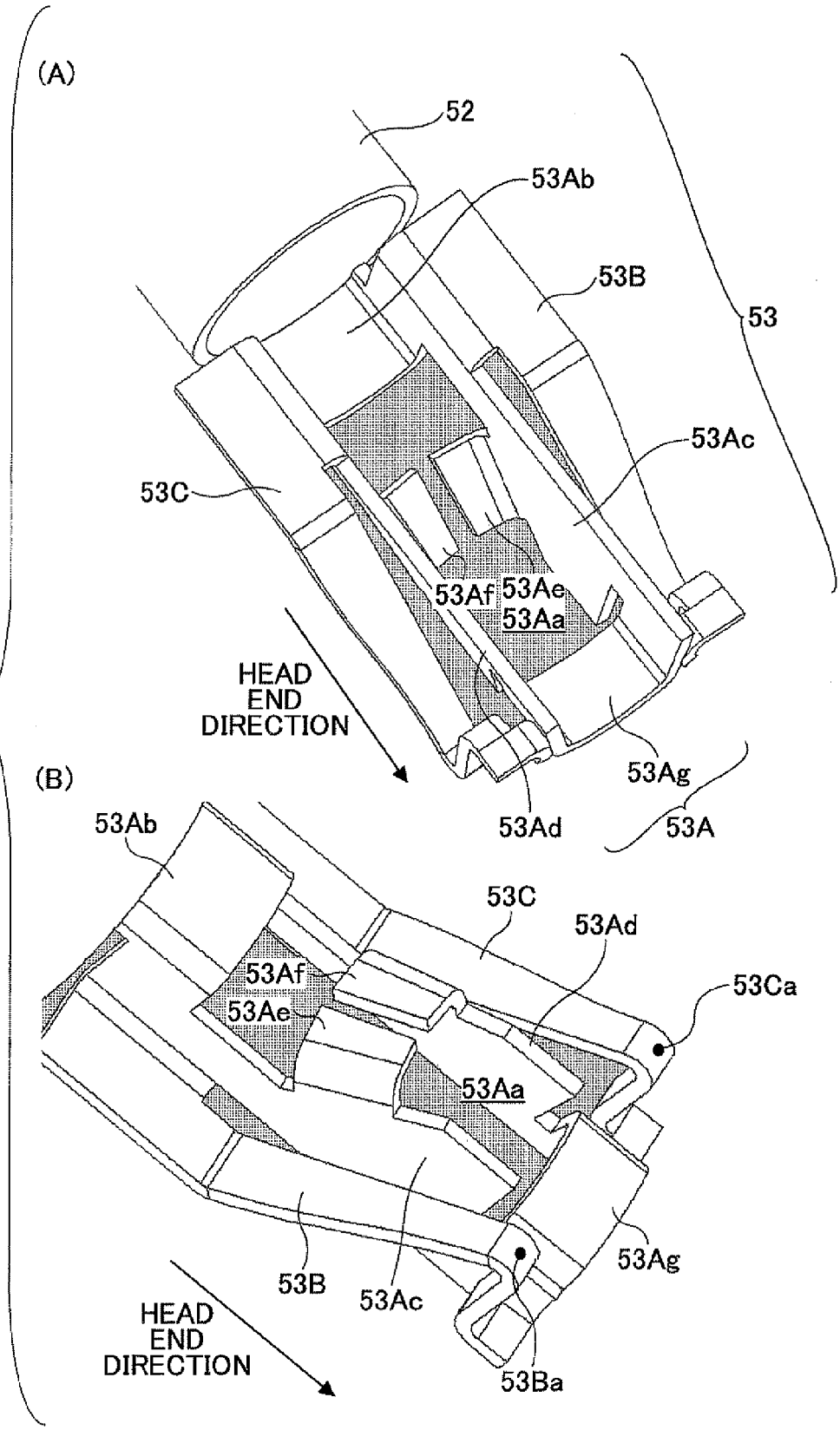
FIG. 15 is a perspective view of the second contact part 53 of the ground contact 50 of another embodiment of the present invention seen from two different directions.
Figure 16:
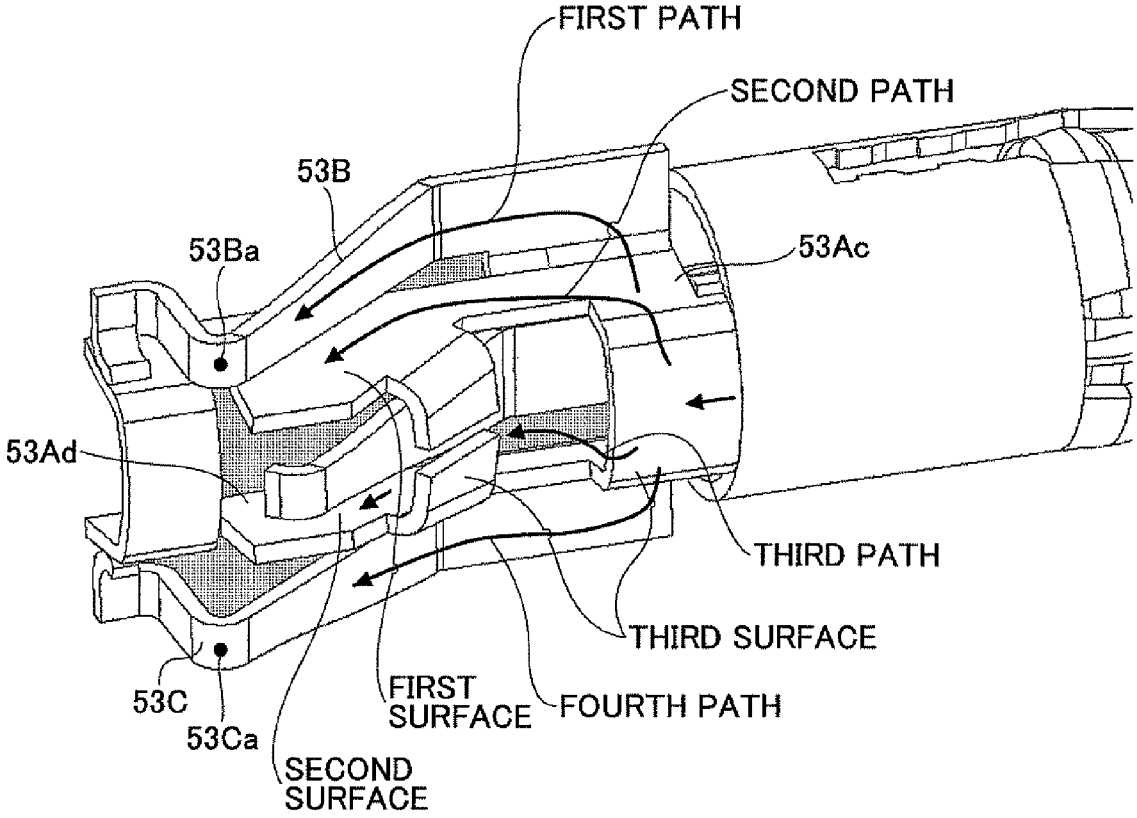
FIG. 16 is a view where the contact 30 is provided at the board 100 seen from the bottom side (a side where the board 100 is provided).

FIG. 15 is a perspective view of the second contact part 53 of the ground contact 50 of another embodiment of the present invention seen from two different directions. FIG. 16 is a view where the contact 30 is provided at the board 100 seen from the bottom side (a side where the board 100 is provided).

For example, as shown in FIG. 15, the center member 53A may further include guide parts 53Ae and 53Af which are bent and extend from the side wall parts 53Ac and 53Ad and face the second connecting part 53 of the ground contact 50 in a direction substantially the same direction as the bottom plate part 53Ab.

With this structure, as shown in FIG. 16, the second connecting part 43 of the signal contact 40 is surrounded by three surfaces, namely a first surface formed by the side wall part 53Ac of the ground contact 50, a second surface formed by the side wall part 53Ad, and a third surface formed by the bottom plate part 53Ab and the guide parts 53Ae and 53Af. Therefore, in this case compared to a case where a member of the signal contact projecting toward the board is not surrounded by the ground members, it is possible to effectively prevent the entry of the disturbance into the plug pin 71 and the signal contact 30.

According to the embodiments of the present invention, it is possible to provide a coaxial connector where a plug having a coaxial structure is connected in a direction substantially parallel with a board, the board being where the coaxial connector is mounted, the coaxial connector including a signal contact having one end connected to a plug pin and another end bent or curved toward the board; and a ground contact having a substantially cylindrical shaped main body part, the main body part surrounding a part of the signal contact, the ground contact being connected to a plug side ground member by a first connecting part formed at one end of the main body part, the ground contact being connected to the board by a second connecting part formed at another end of the main body part, wherein the second connecting part includes a center member surrounding two or more surfaces of the signal contact, the center member having a hole part pierced by the bent or curved portion of the signal contact, the center member having a cross section of a substantially rectangular shape without one side; and an arm part extending from a side part of the center member, the arm part having an end part separated from and facing a head end part of the center member, wherein the end part of the arm part comes in contact with the head end part of the center member by fixing a housing to the board so that a part of the arm part is pressed and makes contact with an electrode of the board due to an elastic force generated at the arm part.

According to the embodiment of the present invention, it is possible to provide a coaxial connector whereby removal from a board or impedance matching can be easily performed and which can correspond to high speed transmission and a connector device including the coaxial connector.

Two of the arm parts may be provided at corresponding side parts of the center member. A plurality of sets of the signal contact and the ground contact may be provided. The first connecting part may be connected to the plug side ground member at least two portions, a base side and a head end of the first connecting part.

According to the embodiments of the present invention, it is possible to provide a connecting device, including the above-mentioned coaxial connector, and a plug having the plug side ground member connected to the ground contact due to an elastic restoring force.

The present invention can be applied to the business of manufacturing computers or their peripheral devices.

What is claimed is:

1. A coaxial connector where a plug having a coaxial structure is connected in a direction substantially parallel with a board, the board being where the coaxial connector is mounted, the coaxial connector comprising:

a housing including a contact housing hole;

a signal contact having one end connected to and supported by a plug pin of the plug and another end bent or curved toward the board; and a ground contact having a substantially cylindrical shaped main body part, the main body part surrounding a part of the signal contact, the ground contact being connected to a plug side ground member by a first connecting part formed at one end of the main body part, the ground contact being connected to the board by a second connecting part fanned at another end of the main body part, a part of the cylindrical shaped main body of the ground contact being supported in the contact housing hole of the housing, wherein the second connecting part includes a center member surrounding two or more surfaces of the signal contact, the center member having a hole part pierced by the bent or curved portion of the signal contact, the center member having a cross section of a substantially rectangular shape without one side; and an arm part extending from a side part of the center member, the arm part having an end part separated from and facing a head end part of the center member, wherein the end part of the arm part comes in contact with the head end part of the center member by fixing the housing to the board so that a part of the arm part is pressed and makes contact with an electrode of the board due to an elastic force generated at the arm part.

2. The coaxial connector as claimed in claim 1, wherein two of the arm parts are provided at corresponding side parts of the center member.

3. The coaxial connector as claimed in claim 1, wherein a plurality of sets of the signal contact and the ground contact is provided.

4. The coaxial connector as claimed in claim 1, wherein the first connecting part is connected to the plug side ground member at least two portions, a base side and a head end of the first connecting part.

5. A connecting device, comprising:

the coaxial connector as claimed in claim 4, and the plug having the plug side ground member connected to the ground contact due to an elastic restoring force.

* * * * *